US005962368A

United States Patent [19]

Poole

[11] Patent Number: 5,962,368

[45] Date of Patent: Oct. 5, 1999

[54] PROCESS FOR DECORATION BY SUBLIMATION USING HEAT SHRINK FILM

[75] Inventor: Mark A. Poole, Aurora, Colo.

[73] Assignee: Kolorfusion International Inc., Englewood, Colo.

[21] Appl. No.: 09/089,687

[22] Filed: Jun. 3, 1998

[51] Int. Cl.[6] ..... B41M 5/035; B41M 5/38

[52] U.S. Cl. ..... 503/227; 156/235; 156/277; 428/913; 428/914

[58] Field of Search ..... 8/471; 156/235, 156/277; 428/195, 913, 914; 503/227

[56] References Cited

U.S. PATENT DOCUMENTS

| | | | |
|---|---|---|---|
| 2,647,337 | 8/1953 | Martin et al. | 41/1 |
| 4,021,591 | 5/1977 | DeVries et al. | 428/200 |
| 4,314,813 | 2/1982 | Masaki | 8/468 |
| 4,465,489 | 8/1984 | Jenkins et al. | 8/471 |
| 4,591,360 | 5/1986 | Jenkins et al. | 8/471 |
| 4,715,931 | 12/1987 | Schellhamer et al. | 162/199 |
| 4,980,008 | 12/1990 | Woods et al. | 156/230 |
| 4,997,506 | 3/1991 | Redher et al. | 156/235 |
| 5,308,426 | 5/1994 | Claveau | 156/234 |
| 5,382,313 | 1/1995 | Eminger | 156/583.1 |
| 5,718,792 | 2/1998 | Goode | 156/228 |

FOREIGN PATENT DOCUMENTS

| | | | |
|---|---|---|---|
| 1223330 | 6/1960 | France | 503/227 |
| 1363852 | 8/1974 | United Kingdom | 503/227 |

*Primary Examiner*—Bruce H. Hess
*Attorney, Agent, or Firm*—Gray, Plant, Mooty, Mooty & Bennett, P.A.; Malcolm D. Reid, Esq.

[57] ABSTRACT

A process for applying a decoration into the surface of an object by sublimation ink printing uses, as the ink support or transfer sheet, a heat shrink film imprinted with sublimation ink decoration. Another process for applying a decoration into the surface of an object by sublimation ink printing uses a conventional ink support or transfer sheet, and a heat shrink film overwrap. The film sheet may be seamed to form an enclosure with the sublimation ink decoration, if any, on the enclosure inner surface. The object to be decorated is positioned inside the film enclosure. If a conventional transfer sheet is used, the conventional transfer sheet is positioned to the object before the heat shrink film is overwrapped. Before the sublimation ink imprinting, the object may be pre-treated with a coating into which the decoration will be imprinted. The film enclosure is heated to shrink the film into conformity with the object surface. Shrinkage of the film about the object applies the necessary pressure, when combined with heat, to transfer the decoration from the film into the surface or coating of the object to be decorated. After the sublimation transfer is complete, the film may be retained as an overwrap or may be removed, along with the optional conventional transfer sheet, revealing the newly decorated object.

15 Claims, 6 Drawing Sheets

| Property | Test | Units | 48 Gauge | 65 Gauge | 80 Gauge | 150 Gauge |
|---|---|---|---|---|---|---|
| Thickness | ASTM, D374 | in. | 0.00048 | 0.00065 | 0.00080 | 0.00150 |
| Yield | - | $in^2/lb$ | 41,700 | 30,800 | 25,000 | 13,400 |
| Unit Weight | ASTM D882 (0.5 $m^2$) | lb/ream | 10.4 | 14.0 | 17.3 | 32.3 |
| Ten. Strength (Ultimate) | ASTM D882 | kpsi, MD<br>TD | 25<br>25 | 31<br>34 | 31<br>34 | 31<br>34 |
| Elongation at Break | ASTM D882 | %, MD<br>TD | 120<br>120 | 120<br>110 | 150<br>110 | 150<br>110 |
| Modulus | ASTM D882 | kpsi, MD<br>TD | 450<br>450 | 450<br>450 | 450<br>450 | 450<br>450 |
| Haze | ASTM D1003 | % | 6.0 | 10.5 | 12.0 | 12.0 |
| Shrinkage | 5 sec in boiling water | %, MD<br>TD | 50<br>50 | 45<br>50 | 45<br>50 | 45<br>50 |
| WVTR | ASTM F1249 38°C (100°F) 90% RH | $g/100in^2$ day | 2.8 | 2.6 | 1.7 | 1 |
| Oxygen Permeability | ASTM D3985 22°C (72°F°) | $cc/100in^2$ day-atm<br>Before Shrinkage<br>After Shrinkage | 9<br>4.5-6 | 8<br>4-5 | 7<br>3-4 | 5<br>2-3 |

*Fig. 7*

PROCESS FOR DECORATION BY SUBLIMATION USING HEAT SHRINK FILM

BACKGROUND OF THE INVENTION

1. Field of the Invention

In one embodiment, the present invention is a process for decorating an object with a sublimation ink using, as the ink support or transfer sheet, a heat shrink film imprinted with the desired sublimation ink decoration. In another embodiment, the present invention is a process for decorating an object with a sublimation ink using a conventional sublimation ink imprinted transfer sheet and then enclosing the object and transfer sheet in heat shrink film. According to either process, heating the heat shrink film provides both the pressure and the heat to transfer the decoration into the surface of the object or into a pre-applied coating on the object surface.

2. Description of Related Art

The technology for transfer printing with sublimation ink developed in the late 1950's. French Patent No. 1,223,330, issued in June 1960 and assigned to Filatures Prouvost of France, describes technology that became the basis for sublimation ink transfer printing of fabrics. In 1968, Sublistatic of Switzerland developed the first commercial transfer printing application using sublimation ink. The sublimation ink was first printed onto a paper carrier transfer sheet to be sublimated onto a polyester or polyester-containing textile by application of heat and pressure. Roger Lepoutry, a founding member of Sublistatic, is now a consultant for Kolorfusion International Inc., Englewood, Colo., the assignee of the present application.

The known process, as applied to printing fabrics, involves vapor phase printing using dispersed dyes printed on paper and applied to the textile materials under pressure at temperatures between about 280° to about 400° F. for approximately thirty seconds. Suitable dispersed dyes for this process come from three classes: azo dyes, nitroarylamine dyes and anthraquinone dyes. Dispersed dyes when heated sublime, changing from a solid state to a gaseous state without passing through a melted or liquid state. A common example of a form of sublimation is the vaporization of dry ice (solid carbon dioxide), which evaporates to a gas without melting.

Processing three-dimensional objects with a sublimation ink pattern that has been printed on paper is often unsatisfactory. Because the paper transfer sheet cannot properly deform along its principal axes to the shape of the three-dimensional object, irregularities appear in conforming the sheet to the object. The paper sheet creases or crumples when positioned in a vacuum around the object to be decorated. At the moment of sublimation, these creases transfer into the surface of the object, thus adversely affecting the quality of the image produced. The paper sublimation ink transfer sheet prevents satisfactory decoration of spherical, curved, ovoid or other irregularly shaped objects.

Other references to printing or decorating with sublimation inks have used various other transfer sheet materials. For example, Recher, et al., U.S. Pat. No. 4,997,506, issued Mar. 5, 1991, explains at col. 2, lines 62–63 that ". . . the support of the coloring agents is a paper support." British Patent No. 52710/70 relates at page, column 2, that ". . . the carrier material for the sublimable water-insoluble dyestuff will normally consist of a cellulosic sheet material, in particular paper, but may alternatively consist of a metal foil or a metal foil supported upon a cellulosic material." Masaki, U. S. Pat. No. 4,314,813, issued Feb. 9, 1982, states at col. 5, lines 25–30 that ". . . the material for the base sheet 1 is not particularly limited as far as it satisfies the aforementioned conditions, and wood free paper and laminated paper composed of a paper layer and an aluminum foil or a cellophane layer may be preferably used." Note that cellophane is a treated regenerated cellulose and is not heat shrinkable. Claveau, U. S. Pat. No. 5,308,426, issued May 3, 1994, discloses at col. 2, lines 7–10 that "The process of decoration according to the invention is carried out using an ink support made of an extensible air-permeable material such as for example a woven fabric, knitted fabric or sheet of non-woven material." Heat shrink films are air impermeable. There has been no teaching or suggestion that a heat shrink film material may be used as a sublimation ink support or transfer sheet.

In the Claveau process, a silicone membrane totally encapsulates the object to be decorated by sublimation ink printing. Vacuum draws the membrane into intimate contact with the object and heat is provided, for example, in a convection oven. The process, while providing decorated objects of exceptional brilliance, requires excessive time for proper vacuum application and for the object to reach a temperature at which sublimation inks transfer into the object surface. Also, the vacuum enclosure adds to the time, energy and expense of the process.

So, there is a need for a process of sublimation ink printing of objects that provides exceptional brilliance, clarity and intensity of color and pattern, while eliminating the need for separately applying pressure on the transfer sheet to the object. There is also a need for a transfer sheet that will conform to the object to achieve clear, distortion-free pattern decoration. And, in the process of sublimation ink printing of objects using conventional sublimation ink transfer sheets, such as paper, metal foil, cellophane and other traditional transfer sheet materials, there is a need to simplify the application of the heat and pressure needed for transfer printing.

SUMMARY OF THE INVENTION

In one embodiment, the process of this invention uses heat shrink film as a sublimation ink support or transfer sheet for sublimation imprinting onto an object. The sublimation ink decoration is first imprinted onto a heat shrink film. The object is enveloped in the heat shrink film, so that the sublimation ink imprinted surface is in direct contact with the surface of the object to be decorated. Optionally, the object may be pretreated with a coating into which the sublimation ink decoration will be received. Application of heat shrinks the film into conformity with the object surface. Shrinkage of the film around the object applies the necessary pressure, combined with the applied heat, to transfer the decoration from the film into the surface of the object or into the pre-applied coating on the object to be decorated. After completing the sublimation ink transfer, removal of the film reveals the decorated object.

The heat shrink film support or transfer sheet may be a polyester heat shrink film, optionally pre-treated with a corona surface treatment that improves adhesion and printability of sublimation inks onto the heat shrink film surface. The sublimation ink imprinted heat shrink film may be seamed into a tube or other shape, approximating the shape of the object to be decorated, or the imprinted film may be directly applied to the object to be decorated with a high-temperature-resistant adhesive or tape.

An alternate process of this invention uses any conventional sublimation ink support or transfer sheet for sublimation imprinting onto an object. The sublimation ink decoration is first imprinted onto any conventional sublimation ink support or transfer sheet by any conventional sublimation ink printing process. The conventional imprinted transfer sheet is positioned with the imprinted surface to the object. The object and the transfer sheet are enveloped in heat shrink film. Application of heat shrinks the film and imprinted transfer sheet into conformity with the object surface. Shrinkage of the film and imprinted transfer sheet around the object applies the necessary pressure, combined with the applied heat, to transfer the decoration from the film into the surface or into the pre-applied coating on the object to be decorated. After completing the sublimation ink transfer, removal of the film and the conventional transfer sheet reveals the decorated object.

The heat shrink film may be a polyester heat shrink film. The heat shrink film may be seamed into a tube or other shape, approximating the shape of the object to be decorated with the conventional transfer sheet, or the film may be directly applied to the object to be decorated with the conventional transfer sheet by a high-temperature-resistant adhesive or tape.

After sublimation printing by either of the processes of this invention, distortion-free printing of the decoration from the heat shrink film or the conventional transfer sheet into the product surface or coating is achieved. The object to be decorated may be selected from such materials as metal, including steel or aluminum, plastic, composite material, including graphite, wood, ceramic, clay, glass or textile. Hockey sticks, baseball bats, fishing poles, ski poles, golf club shafts, bottles and gas or liquid-containing cylinders are representative examples of products that may be decorated by these new processes.

BRIEF DESCRIPTION OF THE DRAWINGS

FIG. 7 is a table of characteristics of a suitable heat shrink film for use in either process of this invention.

DETAILED DESCRIPTION OF THE INVENTION

A. Process Using Sublimation Ink Imprinted Heat Shrink Film

Figure 1:
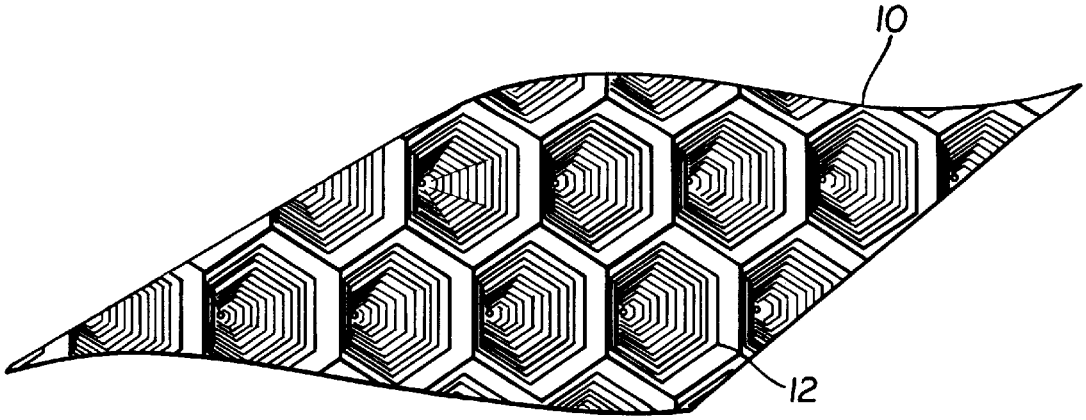
FIG. 1 shows a support or transfer sheet of heat shrink film imprinted with a sublimation ink decoration.
Figure 2:
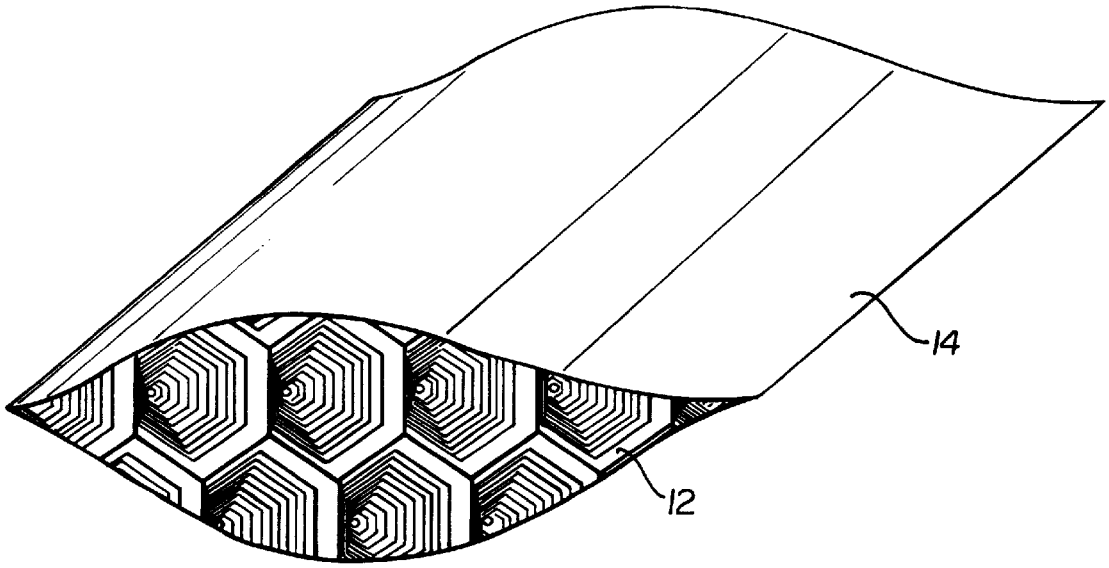
FIG. 2 shows the imprinted heat shrink film seamed to form an enclosure with the sublimation ink decoration on the inner surface of the enclosure.
Figure 3:
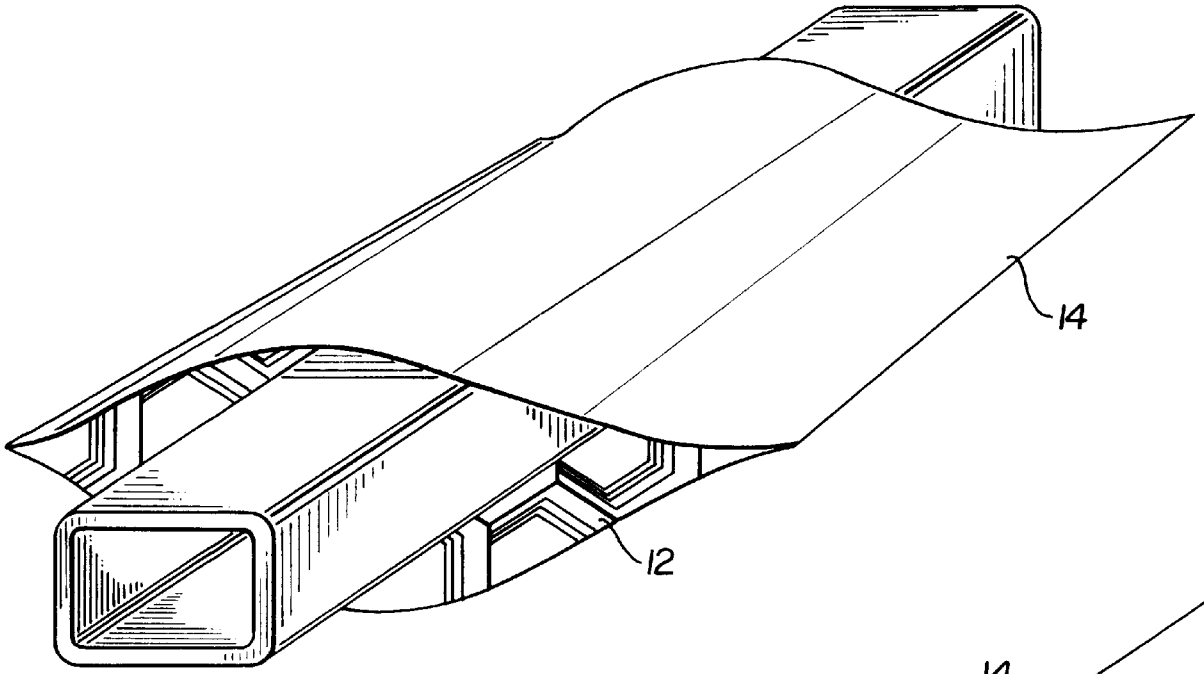
FIG. 3 shows the object to be decorated positioned inside the film enclosure of FIG. 2.
Figure 4:
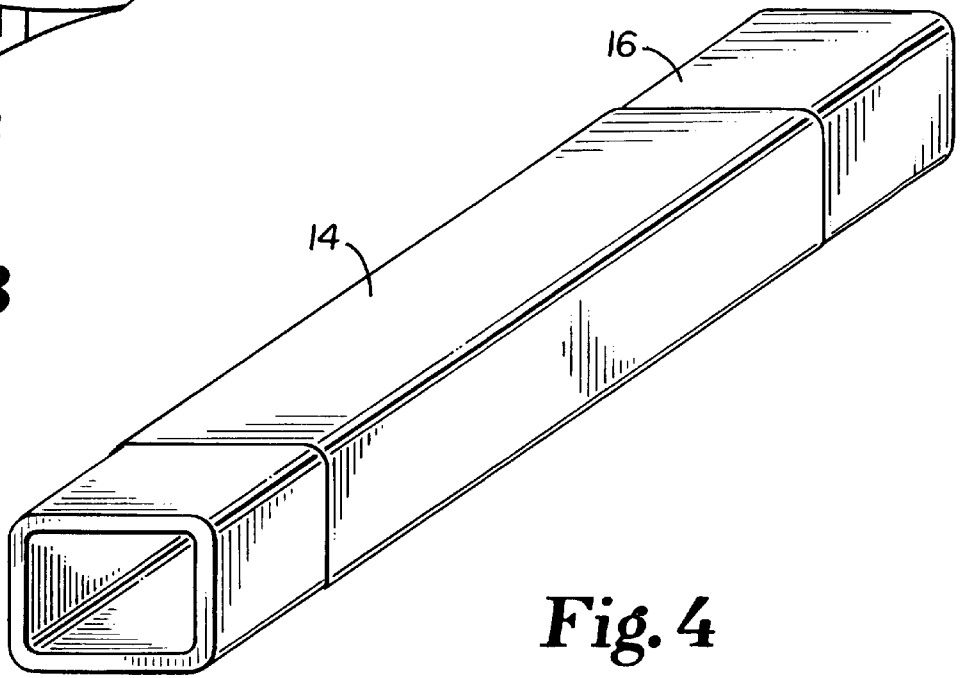
FIG. 4 shows the object of FIG. 3 after application of heat to shrink the film into conformity with the object surface.
Figure 6:
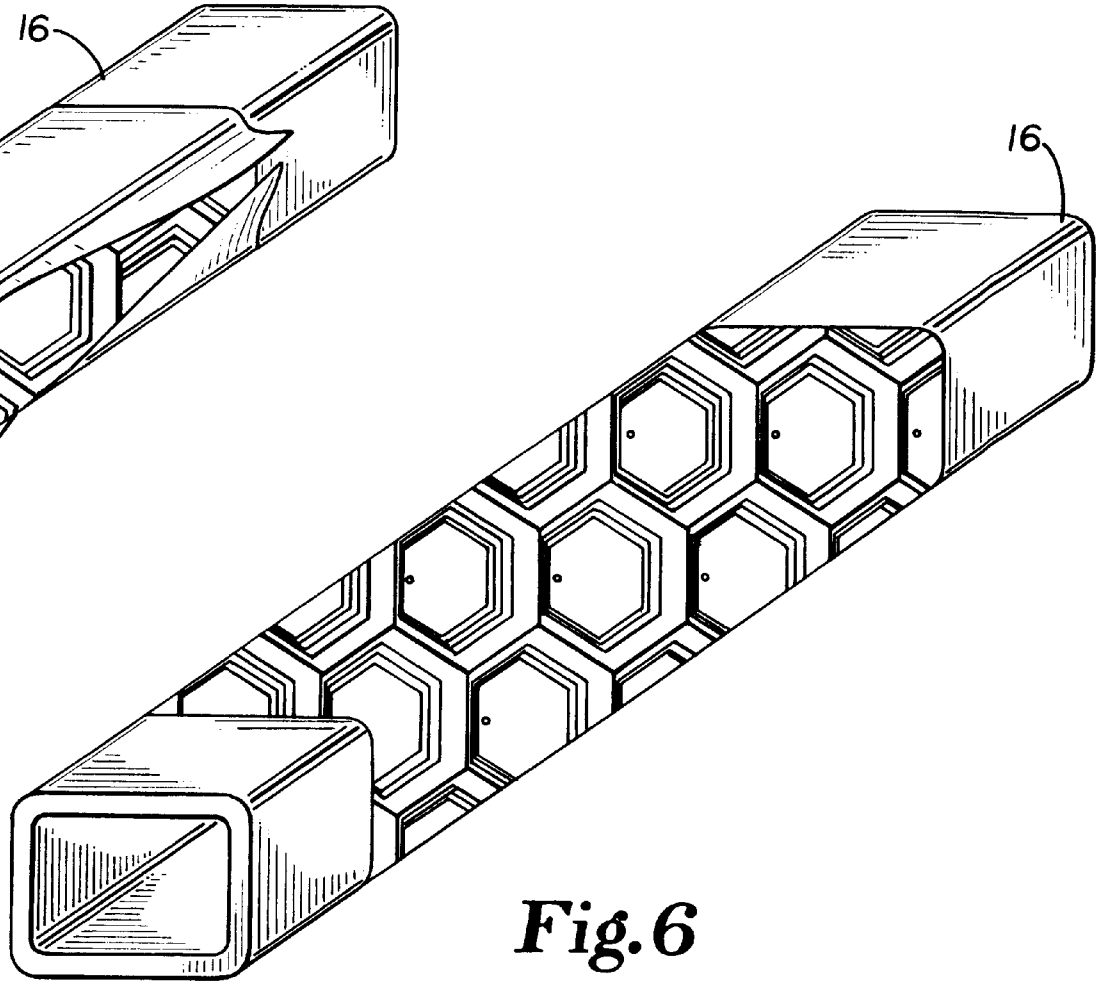
FIG. 6 shows the decorated object after complete film removal.
Figure 5:
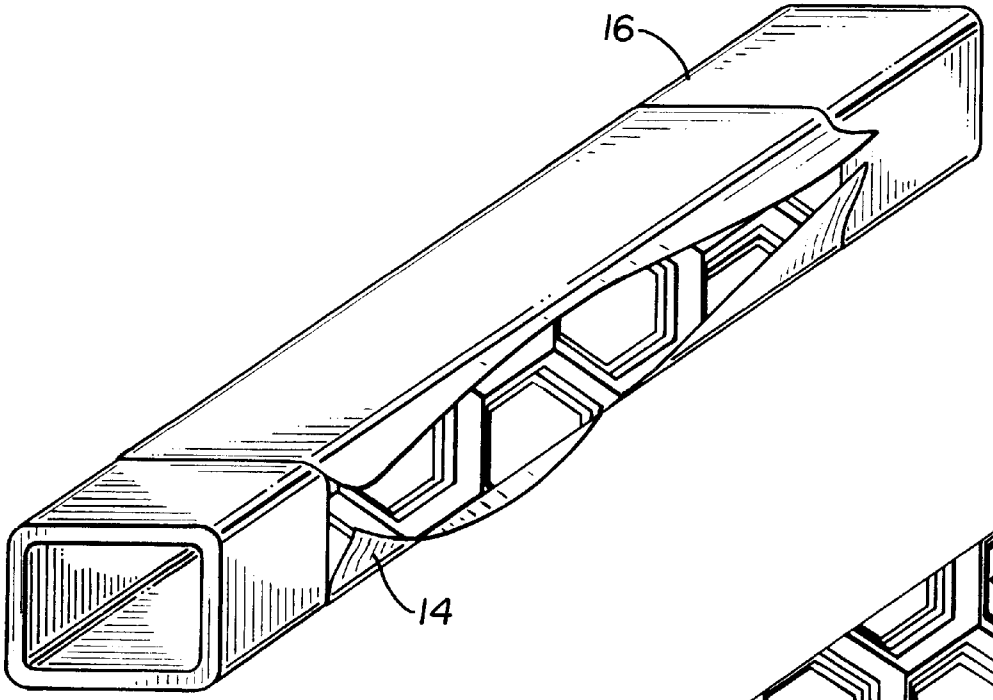
FIG. 5 shows removal of the film, after the sublimation transfer is complete, revealing the newly decorated object.

The process of this invention, which uses a heat shrink film directly imprinted with a sublimation ink decoration for transfer to an object, will be described with reference to FIGS. 1–6. FIG. 1 shows a support or transfer sheet 10 of heat shrink film 10 imprinted with a sublimation ink decoration 12. The heat shrink film may be a polyester heat shrink film, of the type that is used in the packaging industry. The heat shrink film is further defined as a polyethylene terephthalate (PET) film that is not heat stabilized, so that it will shrink with considerable force when exposed to heat. The heat shrink film transfer sheet 10 is printed with the sublimation ink decoration 12, for example, by offset, rotogravure, ink jet printing or other suitable printing process. Sublimation inks are well known and readily commercially available. Although the sublimation ink decoration 12 is shown as a pattern in FIGS. 1–6, it will be understood that the decoration may be a solid color or any desired pattern. After the sublimation ink decoration 12 has been applied to the heat shrink film transfer sheet 10 through a printing process, the sheet 10 may be seamed, as seen in FIG. 2, correctly aligning the decoration at the seam, to form an enclosure 14 with the sublimation inks on the inner surface of the enclosure 14. This ensures that the sublimation ink decoration 12 printed on the film transfer sheet 10 will be in direct contact with the surface of the object 16 to be decorated. The object 16 to be decorated is now placed inside the film enclosure 14, as seen in FIG. 3. The enclosure 14 may then be positioned if registration of the object 16 to the decoration 12 is required. Heat is applied to shrink the film transfer sheet 10 into conformity to the surface of the object 16, as seen in FIG. 4. Application of heat to shrink the film transfer sheet 10 provides both the needed pressure and the needed heat to transfer the sublimation ink decoration 12 from the film transfer sheet 10 into the surface of the object 16 to be decorated or into a coating pre-applied to the object 16. After the sublimation transfer is complete, the film transfer sheet 10 may be removed, as in FIG. 5, revealing the newly decorated object 16, as in FIG. 6. Alternatively, the film transfer sheet 10 may be allowed to remain on the object 16 as a wrapping or covering to be removed by the consumer. The decoration is not simply on the surface of the object, but has penetrated into the surface of the object, or into a pre-applied coating on the object surface. The decoration is imbedded into the object surface and is as durable as the coating or surface.

Figure 10:
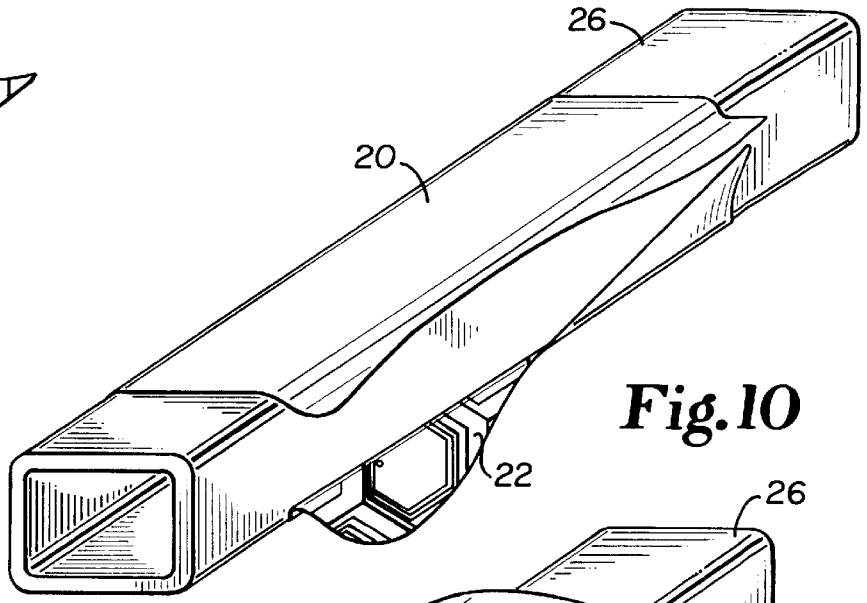
FIG. 10 shows the object to be decorated wrapped with the conventional transfer sheet of FIG. 8.
Figure 11:
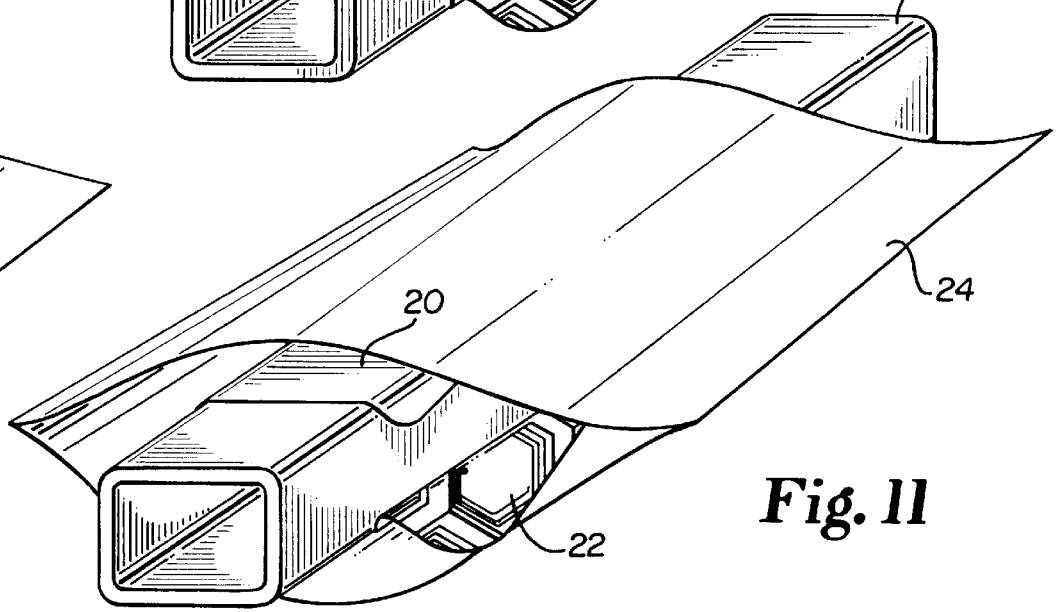
FIG. 11 shows the object to be decorated wrapped with the conventional transfer sheet, as shown in FIG. 10, positioned inside the heat shrink film enclosure of FIG. 9.
Figure 8:
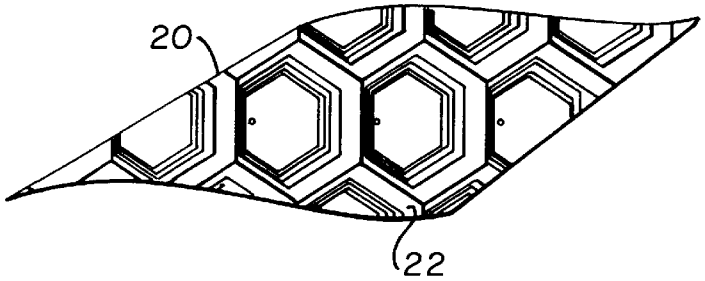
FIG. 8 shows a conventional sublimation ink imprinted transfer sheet.
Figure 9:
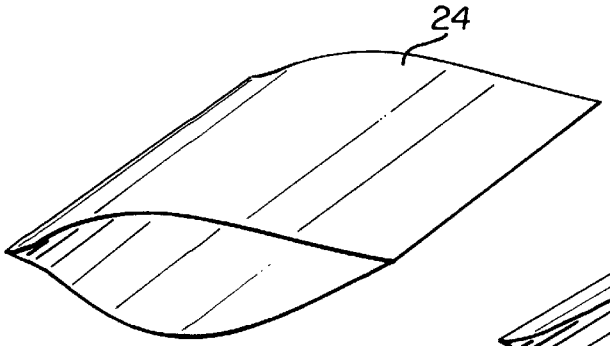
FIG. 9 shows a heat shrink film seamed to form an enclosure.
Figures 12, 13:
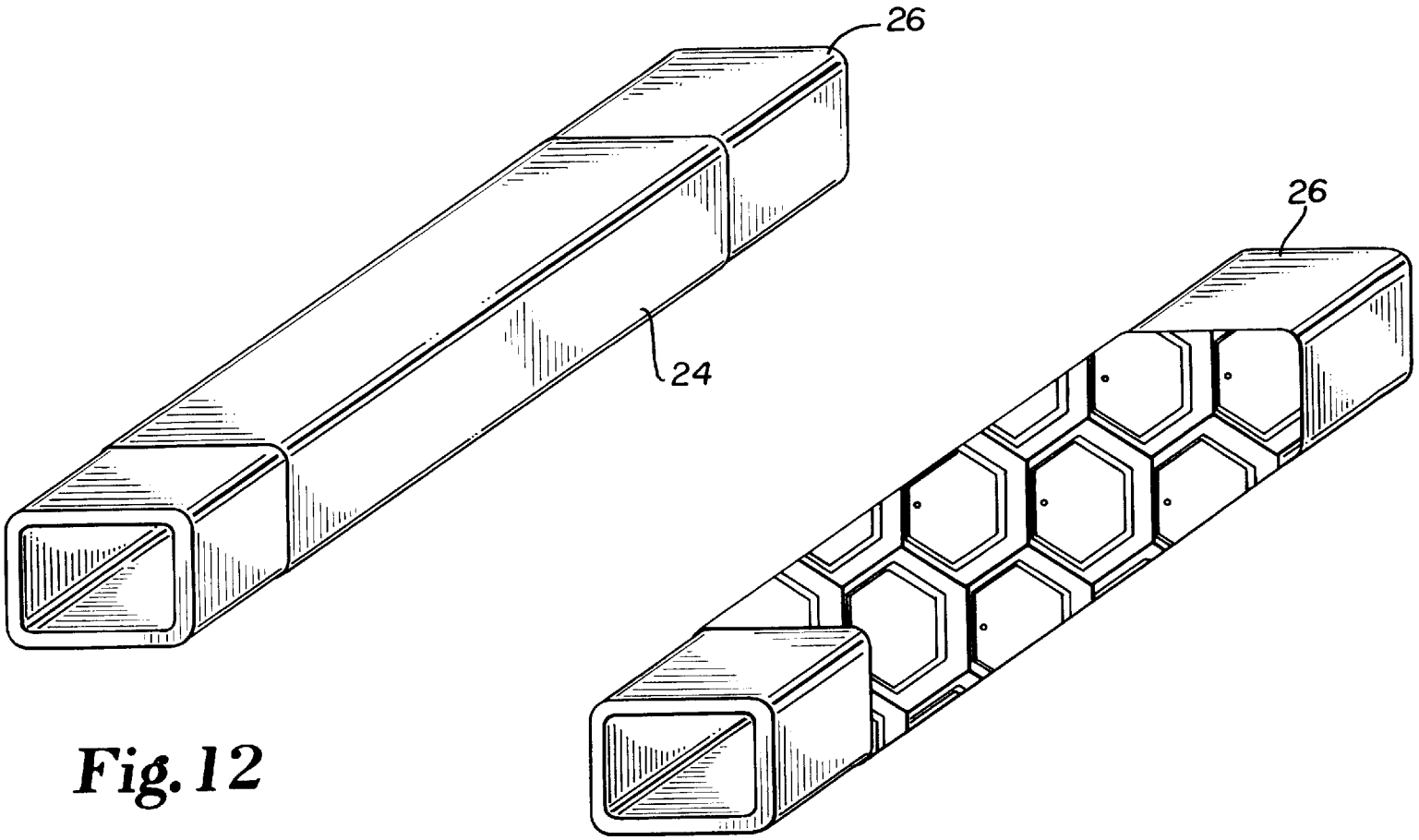
FIG. 12 shows the object after application of heat to shrink the film enclosure and conventional transfer sheet, shown in FIG. 11, into conformity with the object surface.
FIG. 13 shows the decorated object after complete removal of the film and conventional transfer sheet.

B. Process Using Any Conventional Sublimation Ink Imprinted Transfer Sheet Together With a Heat Shrink Film The alternate process of this invention, which uses any conventional sublimation ink imprinted transfer sheet, together with a heat shrink film overwrap, for transfer to an object, will be described with reference to FIGS. 8–13. FIG. 8 shows a conventional sublimation ink transfer sheet 20 imprinted with a sublimation ink decoration 22. The transfer sheet 20 may be any type of transfer sheet that is known in the art to be useful for transferring a sublimation ink decoration 22 to an object to be decorated. Also, the sublimation ink transfer sheet 20 may be imprinted on the transfer sheet by any known method of imprinting sublimation inks. Although the sublimation ink decoration 22 is shown as a pattern in FIGS. 8–13, it will be understood that the decoration 22 may be a solid color or any desired pattern. Sublimation inks are themselves well known and readily commercially available. FIG. 9 shows a heat shrink film seamed to form an enclosure 24. The heat shrink film is the same type of polyester heat shrink film mentioned above with reference to Process A. FIG. 10 shows the object 26 to be decorated wrapped with the conventional imprinted transfer sheet 20 of FIG. 8. FIG.11 shows the object 26 to be decorated wrapped with the conventional imprinted transfer sheet 20, as shown in FIG. 10, positioned inside the heat shrink film enclosure 24 of FIG. 9. The transfer sheet 20 and the enclosure 24 are positioned relative to each other and relative to the object 26 to register the decoration 22 as needed. Heat is applied to shrink the enclosure 24 and the transfer sheet 20 into conformity with the surface of the object 26, as seen in FIG. 4. Application of heat to shrink the enclosure 24 also provides the needed pressure and heat to transfer the sublimation ink decoration 22 from the transfer sheet 20 into the surface of the object 26 to be decorated or into a coating pre-applied to the object 26. FIG. 12 shows the object 26 after application of heat to shrink the film enclosure 24 and conventional transfer sheet 20, shown in FIG. 11, into conformity with the object surface 26. After the sublimation transfer is complete, the enclosure 24 may be removed, revealing the newly decorated object 26, seen in FIG. 13. Alternatively, the film enclosure 24 may be allowed to remain on the object 26 as a wrapping or covering to be removed by the consumer. The decoration has penetrated into the surface of the object, or into a pre-applied coating on the object surface. The decoration is imbedded into the object surface and is as durable as the coating or surface.

Traditional uses for heat shrink film, used in both Processes A and B of this invention, have been for product labels, product safety tamper-evident bands, seals for frozen food containers, food packaging and combo pack sleeves. The label industry also uses heat shrink film to cost-effectively label generally cylindrical objects, such as metal cans, glass and plastic bottles. Polyethylene terephthalate heat shrink film generally has the ability to shrink up to 50% when heat is applied, for example, by a heat gun, heat tunnel or even a hair dryer. For purposes of the present invention, it is not necessary that the heat shrink film shrink to its full capacity. The heat shrink film need only shrink enough to maintain tight surface contact with the object to be decorated, and this may be as low as 5% shrinkage. Also, the heat shrink film may initially be only partially shrunk to the object at a lower temperature for any needed positioning or alignment of the decoration to the object. This lower temperature is chosen to provide enough heat to only partially shrink the heat shrink film, but insufficient heat to begin transfer of the sublimation ink. The shrink activation temperature is generally in the range of from about 220° F. to about 440° F. For the purposes of this process, it is preferred to use heat shrink films that will withstand temperatures of about 400° F. and higher to provide rapid and complete sublimation of the decoration into the object. The thickness of the film can typically range from about 0.5 mils to about 3 mils. Polyethylene terephthalate is not known to contain toxic chemicals under Section 313 of Title III of the Superfund Amendments and Reauthorization Act of 1986 and under 40 C.F.R. 372. A suitable heat shrink film for use in either sublimation ink printing process of this invention may generally have the properties such as those set forth in the table of FIG. 7.

Suitable polyethylene terephthalate film satisfying the properties of the table of FIG. 7 is commercially available, for example, from DuPont. MYLAR® HS, an uncoated, transparent polyethylene terephthalate DuPont film designed for heat shrink applications is suitable for use in either Process A or B of this invention. MYLAR® HST, a DuPont heat shrink film with a corona surface treatment to improve adhesion and printability of sublimation inks onto the heat shrink film surface, is also suitable for either Process A or B, but is particularly advantageous for Process A. The heat shrink film, either with or without the sublimation ink imprinting, may be adhered to the object to be decorated (and to the conventional transfer sheet, according to Process B) by adhesives or tape able to withstand the temperatures to be applied for film shrinkage. As described above, for example with reference to FIGS. 2 and 9, the heat shrink film may be adhesive seamed into an enclosure in the shape of tubing or a sleeve. A suitable enclosure may also be a bag or a contoured package to accommodate the shape of the object to be decorated. Other shapes of enclosures may be made from laminations of the heat shrink film and a suitable sealant web, such as are used for the packaging of poultry, meat and fish products. Many shapes of objects may be decorated by the present Processes A and B, and the most successful imprinting of decoration has been with objects that have a fairly uniform cross-section along a longitudinal axis, such as a cylindrical shape or the rectangularly shaped longitudinal object shown in FIGS. 3–6 and 10–13. Generally, objects with compound curves, that is objects with both convex and concave exterior surfaces, are less suitable for decoration by the processes of this invention.

When the heat shrink film is to be imprinted with sublimation inks, for use in Process A of this invention, imprinting can be done by any suitable method for printing PET film. For example, imprinting may be done by offset, rotogravure, ink jet or other suitable printing process. Rotogravure is a printing method that uses precision etched cylinders that can accurately reproduce watercolor, airbrush or photographic designs. The rotogravure process delivers sharp lines and brilliant color with perfect repetitions. Rotogravure can print on heat shrink film in a continuous roll. Offset printing via a sheet fed system is also suitable for applying sublimation ink to heat shrink film. To avoid unwanted premature film shrinkage, special care must be exercised during any printing, treatment or handling operation that may involve heat or drying. The film can be printed with up to eight colors with four color process to provide an infinite range of patterns to meet any application.

A particularly suitable method for printing sublimation inks onto heat shrink film uses a sublimation ink cartridge with a standard office PC ink jet color printer, such as an Epson color printer. The ink cartridges use an ink jet print head that disperses the inks without using heat. The ink jet color printer has the ability to print images at 720 dpi. Larger format ink jet printers, than standard office size printers, allow expanded area printing. Electrostatic printers have a much faster printing capacity than ink jet models, but are far more expensive that ink jet printers.

As mentioned previously, the object to be decorated according to either process of this invention may be of such materials as metal, such as steel or aluminum, plastic, composite material, such as graphite, wood, ceramic, clay, glass or textile. Plastic and aluminum have been successfully sublimation ink imprinted without a pre-applied coating. However, the object to be decorated may optionally be pretreated with a coating before imprinting with the sublimation ink decoration according to either Process A or B of this invention. Suitable coatings may be applied in the form of liquid spray, electrostatic powder or E-coatings. With an electrostatic powder or E-coating, the object to be coated must be electrically conductive or must have a pre-applied electrically conductive coating. The selection of the specific optimal coating for a particular object to be sublimation ink imprinted is readily determined by those of ordinary skill in the art of sublimation ink imprinting. Typically coatings are transparent or may be clear-tinted for a particular decorative effect. Before application of the coating into which the sublimation ink decoration will be imprinted, a white base coat background may be pre-applied to reflect the sublimation ink color or decoration.

The coating must maintain its integrity during the sublimation imprinting process. To prevent the transfer material from sticking to the object, the coating must not re-gel, soften, melt, flow, or become tacky. Thermoset coatings are preferred in the processes of this invention. Thermoset compounds are heat-stable compounds based on lower weight solid resins. Upon heating, these compounds melt, flow and cross-link. Typical thermoset compounds include triglycidyl isocyanate (TGIC) polyester, epoxy, epoxy/polyester (hybrid), polyester urethane, and acrylic formulations. Suitable coatings for use in the process of this invention may be obtained from the following manufacturers. Cardinal Industrial Finishes of Denver, Colo. manufactures a powder white and clear TGIC polyester coating and a liquid high-solids polyurethane. The high solids polyurethane is a two component, cross-linking urethane coating ideally suited for use on metal, plastic or wood. Prismatic Powders, White City, Oreg. manufactures translucent and clear urethane/top coat powder coatings. Tiger Drylac USA Inc., Rancho Cucamonga, Calif. manufactures Tiger Drylac Tribo TGIC polyester glossy clear and translucent coatings, which offer excellent UV resistance and mechanical properties at higher film thicknesses. Valspar Corp., Minneapolis, Minn. also manufactures a TGIC polyester clear powder and an E-coat under the name Vectrocoat 310 that provides a clear coating, for example, on metal objects. Clearclad Coatings, Inc., Harvey, Ill. manufactures Clearclad HSR polyurethane electrocoat, which offers excellent wear resistance, along with resistance to corrosion, tarnish, UV and solvents.

The processes of this invention can be continuous. Where the objects to be decorated are all of the same shape, such as a golf club shaft, the individual objects are slipped into interiorly imprinted sleeves of heat shrink film or are positioned to a conventional sublimation ink imprinted transfer sheet and enclosed with heat shrink film sleeves. The enclosed shafts are exposed to low temperature heat to partially shrink the sleeve about the shaft, without causing sublimation of the imprinted inks, so that correct distortion-free alignment and registration of the pattern can be monitored. At low temperatures and only partial shrinkage, the shaft and the sublimation ink medium can be positioned and aligned before sufficient heat and/or pressure has been applied to transfer the sublimation ink decoration into the shaft. The shafts can then be exposed to a higher temperature for full shrinkage and transfer of the decoration. Partial shrinkage of the heat shrink film allows the shafts to be hung vertically to proceed via conveyor to a higher temperature tunnel for full shrinkage and transfer of the decoration.

Many positive advantages are noted in the decoration processes here described. The heat shrink film shrinks quickly, evenly and tightly over a wide shape range of objects to be decorated. Heat shrink sleeves or enclosures may be designed specifically for many unusually shaped objects and containers. Heat shrink film can incorporate sharply printed UPC codes for use in inventory control and pricing. Partial pre-shrinkage of the heat shrink film to the object at low temperatures allows exact registration of design and text on the surface of the object before final high temperature heating to provide the heat and pressure to transfer the decoration. The application of heat shrink film is easy, efficient and eliminates the need for expensive automated equipment. When a sublimation ink imprinted heat shrink film is used as the transfer sheet, the film can be imprinted to the specifications of the customer and the imprinted film can be provided to the customer, who can then easily conduct the actual transfer of the decoration to the desired object. All gauges of heat shrink film are available with corona surface treatment for improved bonding to inks and adhesives. The process of using heat shrink film with sublimation inks is environmentally safe and does not give off harmful volatile organic compounds into the atmosphere during the production process. Because the heat shrink film is a single use item in this process, preferred options for disposal are recycling, incineration with energy recovery and landfill. The high fuel value of heat shrink film makes energy recovery incineration an attractive option if recycling is not feasible.

That which is claimed is:

1. A process of transferring a sublimation ink decoration into an object comprising:

imprinting a sublimation ink decoration onto a surface of a heat shrink film;

enclosing the object in the film, with the imprinted film surface toward the object;

exposing the enclosed object to heat to shrink the film into intimate contact with the object, thereby providing heat and pressure to transfer the sublimation ink decoration into the object.

2. A process according to claim 1, wherein the object is of plastic or textile.

3. A process according to claim 1, wherein the object has an ink receptive coating applied thereto.

4. A process according to claim 3, wherein the object is of metal,composite material, wood, ceramic, clay or glass.

5. A process according to claim 1, wherein the heat shrink film is polyethylene terephthalate film that is not heat stabilized.

6. A process according to claim 5, wherein the film, before imprinting, is corona surface treated to improve adhesion and printability of sublimation inks onto the film surface.

7. A process according to claim 1, wherein enclosing the object in the film includes adhering the film to the object with adhesive or tape.

8. A process according to claim 1, wherein enclosing the object in the film includes forming the film into an enclosure with the sublimation ink decoration on an inner enclosure surface and positioning the object within the enclosure.

9. A process according to claim 8, wherein the enclosure is formed by seaming the film.

10. A process according to claim 8, wherein the enclosure is formed by laminations of the heat shrink film with a sealant web.

11. A process according to claim 1, wherein the heat is in the range of from about 220° F. to about 440° F.

12. A process according to claim 1, wherein the film is partially shrunk at a low temperature to position the film to the object, before final film shrinkage and imprinting.

13. A process according to claim 1, and including removing the heat shrink film after transfer of the sublimation ink decoration into the object.

14. A process according to claim 1, wherein the object, before being enclosed in the imprinted film, is coated with a liquid spray, electrostatic powder or E-coating.

15. A process according to claim 1, wherein the object, before being enclosed in the imprinted film, is coated with a thermoset coating.

* * * * *